United States Patent [19]

Shibata

[11] 4,187,746

[45] Feb. 12, 1980

[54] POWER WRENCH HAVING RATCHET MEANS AT BOTH SURFACES OF SOCKET THEREOF

[76] Inventor: Tsugio Shibata, 7-2-1, Nagazumi, Minami-ku, Fukuoka-shi, Fukuoka, Japan

[21] Appl. No.: 876,603

[22] Filed: Feb. 10, 1978

[51] Int. Cl.[2] ..... B25B 13/26

[52] U.S. Cl. ..... 81/57.39; 81/58.3

[58] Field of Search ..... 81/57.39, 58.3, 60, 81/58

[56] References Cited

U.S. PATENT DOCUMENTS

| | | | |
|---|---|---|---|
| 982,886 | 1/1911 | Servatius | 81/58.3 |
| 2,697,370 | 12/1954 | Brooks | 81/58 |
| 3,486,402 | 12/1969 | Dunlap et al. | 81/58.3 X |
| 4,079,641 | 3/1978 | Junkers | 81/57.39 |

*Primary Examiner*—James G. Smith

*Attorney, Agent, or Firm*—Frank J. Jordan

[57] ABSTRACT

The power wrench of this invention which can powerfully hold, twist or turn a bolt, nut or screwhead is characterized in that the torquing end of the wrench has ratchet means at both surfaces thereof. Due to the above construction the fastening and loosening of bolt means can be readily conducted with a minimum effort of replacement of the parts thereof. Furthermore, since the power wrench is provided with a right-angular arrangement, optimal wrenching is effected.

10 Claims, 10 Drawing Figures

POWER WRENCH HAVING RATCHET MEANS AT BOTH SURFACES OF SOCKET THEREOF

BACKGROUND OF THE INVENTION

This invention relates to a wrench which can provide easy and rapid fastening or loosening of bolts, and more particularly to a mechanism thereof.

In fastening or dismounting large-sized nuts and bolts which are employed in high-powered rolling mills, various types of power-operated wrenches have been developed and employed, conventionally e.g. a mechanical wrench which includes planetary gears for exerting multiplied force or a hydraulic-operated wrench which rotates the bolts intermittently.

However, such wrenches require the wrench body to be equipped with a different type of bolt-driving element between the fastening and dismounting operation. Namely, such a wrench necessitates the frequent replacement of the bolt-driving elements so that the fastening or dismounting operation has been cumbersome and time-consuming.

It is an object of the present invention to provide a wrench which can resolve the above disadvantages such that it can efficiently conduct the fastening and dismounting operation substantially without incurring the replacement of the bolt-driving element.

It is another object of the present invention to provide a wrench which has a simple and rigid construction consisting of a hydraulic actuator, a drive lever and a reaction force lever and therefore can be manufactured at low cost.

It is still another object of the present invention to provide a wrench which can exert the optimal fastening or dismounting force onto bolts such that the force exerted by a hydraulic actuator, which imparts a torque to the bolts, is always held in a direction perpendicular to the longitudinal axis of the drive lever.

It is a further object of the present invention to provide a wrench which can automatically conduct the fastening or dismounting of bolts without employing any electric or electronic means such as solenoid valves or relays.

Other features and advantages of the invention will be apparent from the following description taken in connection with the accompanying drawings.

DETAILED DESCRIPTION OF THE DISCLOSURE

The wrench of the present invention is described hereinafter in view of a preferred embodiment shown in FIG. 1 through FIG. 8.

Figure 2:
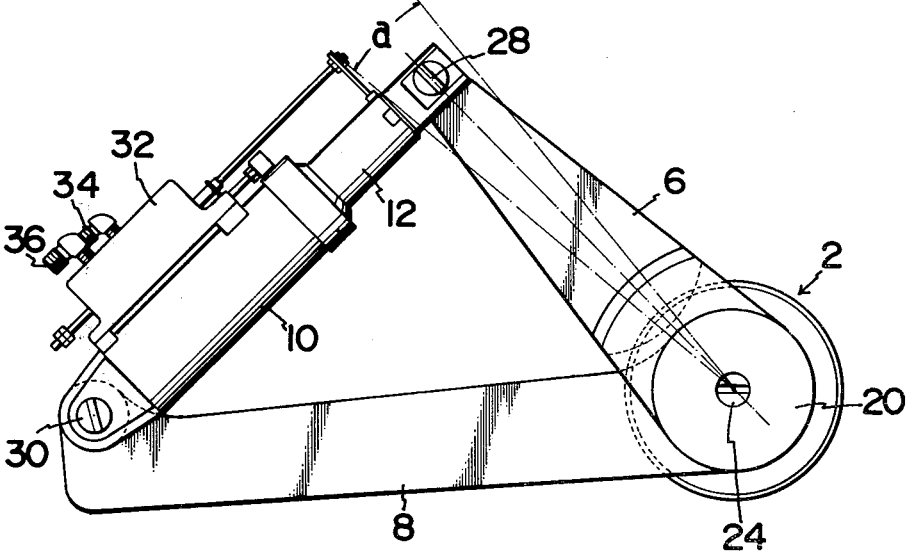
FIG. 2 is a plan view of the wrench of this invention.
Figure 3:
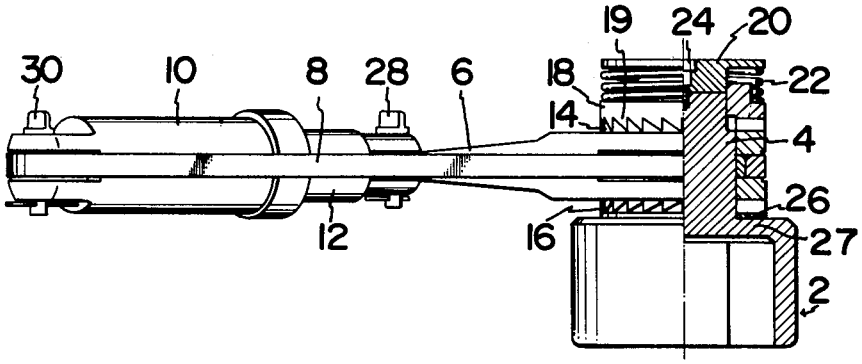
FIG. 3 is a front view with a part in section of the above wrench.

As shown in FIG. 2, the wrench of this invention has substantially a right-angled triangular construction consisting of a drive lever 6, a reaction force lever 8 and a hydraulic actuator 10.

In the above construction, the drive lever 6 has one end thereof rotatably engaged with an engaged portion 4 of a bolt receiving socket 2. The reaction force lever 8 has one end thereof also rotatably engaged with the engaged portion 4. However, they are angularly displaced such that an acute angle is formed between the drive lever 6 and the reaction force lever 8.

The hydraulic actuator 10 is disposed between the above levers 6 and 8 such that a reciprocating rod 12 thereof is pivotally connected at a right angle to the other end of the drive lever 6 by a pivot pin 28 and the base thereof pivotally connected to the other end of the reaction force lever 8, by a pivot shaft 30 thus completing the right-angled triangular construction.

Referring to the construction of a ratchet mechanism provided at the junction where two levers 6 and 8 meet for rotating the bolt receiving socket 2 with the actuation of the hydraulic actuator 10, the circular end of the drive lever 6 is provided with right-hand radial ratchet teeth 14 and left-hand radial ratchet teeth 16 on upper and lower surfaces respectively. The right-hand radial ratchet teeth 14 are meshed with circular ratchet teeth 19 provided at the bottom of a ratchet cap 18 which, in turn, is unrotatably engaged with the upper square part **4*a* of the engaged portion 4. For biasingly engaging the above right-hand ratchet radial teeth 14 and circular ratchet teeth 19, the ratchet cap 18 is compressed downward by a combination of a compression spring 22 and a spring-biasing plate 20. A set screw 24 threaded into the spring-biasing plate 20 is provided for attaching the spring-biasing plate 20 to the engaged portion 4 of the bolt receiving socket 2 as well as for adjusting the compression strength exerted by the spring 22**.

Around the proximal end of the engaged portion 4 is provided a circular flat packing 26. This circular packing 26 is sandwiched between the left-hand radial ratchet teeth 16 and the shoulder 27 of the socket 2 for preventing the breakage or wear of the ratchet teeth 16 during the bolt-fastening operation (These ratchet teeth 16, as described later, are necessary in a bolt-dismounting operation).

Figure 4:
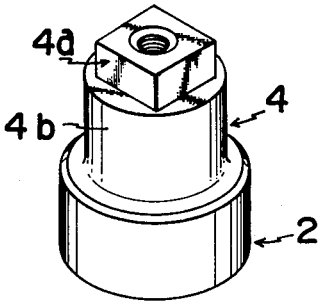
FIG. 4 is a perspective view of a socket which constitutes an element of the above wrench.
Figure 5:
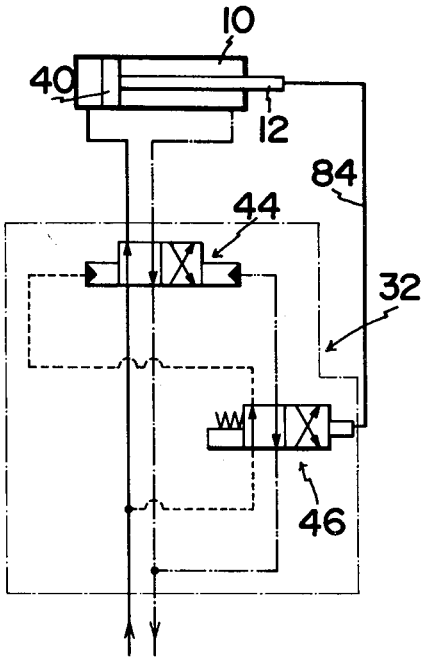
FIG. 5 is a hydraulic circuit diagram employed in the above wrench.
Figure 6:
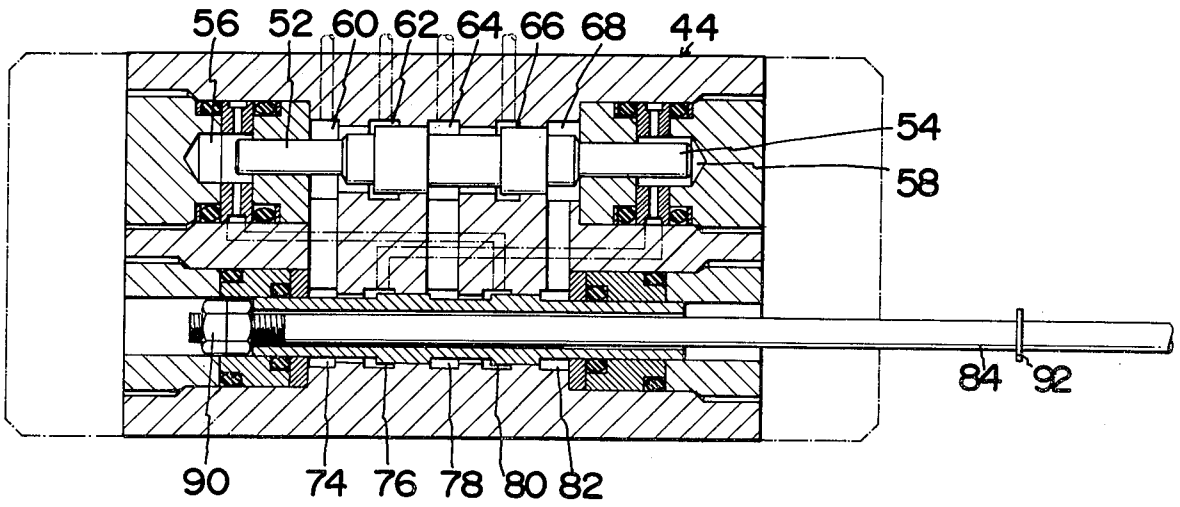
FIG. 6 is a longitudinal cross-sectional view of a mechanical valve which constitutes an element of the above wrench.

As clearly shown in FIG. 4, the engaged portion 4 of the socket 2 consists of an upper part **4*a* of a square cross-section and a lower part 4*b* of a circular cross-section. Due to such construction, along with the ratchet mechanism, the pivotal reciprocation of the drive lever 6 imparts the one-way rotation of the bolt-receiving socket 2 while the reaction force lever 8** transfers the reaction force exerted by the above rotation to a desired stationary object such as a bolt disposed adjacently to the bolt to be fastened.

With respect to the construction of a hydraulic actuator 10, the actuator 10 is provided with a mechanical valve 32 which enables an automatic continuous reciprocating movement of the hydraulic cylinder 10. The valve 32 can be integrally mounted on the hydraulic cylinder 10 and comprises a pressure port 34 and a tank port 36.

The manner in which the wrench of this embodiment is operated is hereinafter disclosed in conjunction with the drawings.

Figure 1:
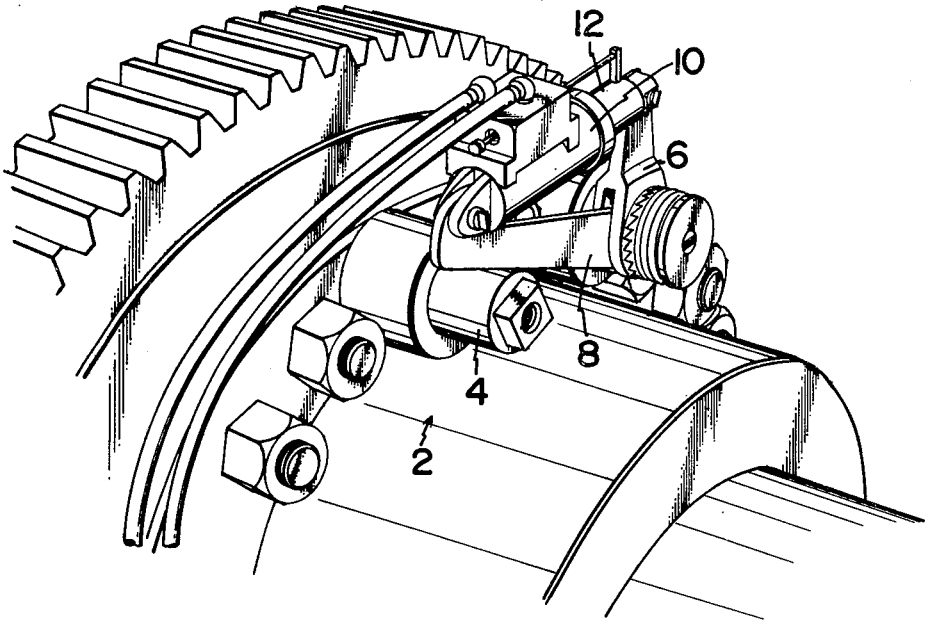
FIG. 1 is a perspective view showing the wrench of this invention mounted on a rolling mill for fastening bolts.

In an operation for fastening the bolt, the socket 2 is snugly displaced over one of the bolts to be fastened while the fulcrum end of the reaction force lever 8 is received on any stationary object such as an adjacent bolt already fastened (In FIG. 1, such fastened bolt is provided with the socket 2 for providing the firm base of receiving the reaction force.). When pressurized fluid is supplied into the hydraulic cylinder 10 by way of the mechanical valve 32, the reciprocating rod 12 of the cylinder 10 automatically continues the reciprocating movement thereof at a desired interval or stroke (a). This reciprocating movement imparts the continuous oscillation of the drive lever 6 and right-hand and left-hand radial ratchet teeth 14 and 16 are integrally formed therein. Since the right-hand ratchet 14 is meshed with the ratchet cap 18, the ratchet cap 18 is moved in a clockwise direction tooth by tooth or intermittently resulting in the rotation of the bolt-receiving socket 2 and the bolt therein.

In an operation for loosening bolts, the setting screw 24 is first removed and subsequently the spring 22, the spring-biasing plate 20 and the ratchet cap 18 are removed. Then the wrench which is still in a triangular construction consisting of the drive lever 6, the reaction force lever 8 and the hydraulic actuator 10 is removed from the socket 2 and is turned over by 180 degrees.

Thus reversed wrench is mounted on a bolt to be dismounted such that the joint where the torque ends of two levers 6 and 8 superpose with each other is disposed on the socket 2. The socket 2 receives such bolt to be loosened wherein the right-hand radial teeth 14 and the left-hand radial teeth 16 are on the lower and upper surface respectively of the circular end of the drive lever 6 respectively. Subsequently, a new ratchet cap 18 having circular teeth capable of meshing with the left-hand radial teeth 16 is provided and mounted on the circular end of the drive lever 6 and finally is compressed by a combination of the compression spring 22 and the spring biasing plate 20. After the above mounting operation, the hydraulic actuator 10 is actuated exactly in the same manner as that of the bolt fastening operation. Due to the above actuation of the cylinder 10, the bolt is intermittently loosened or dismounted by means of the ratchet mechanism.

Figure 9:
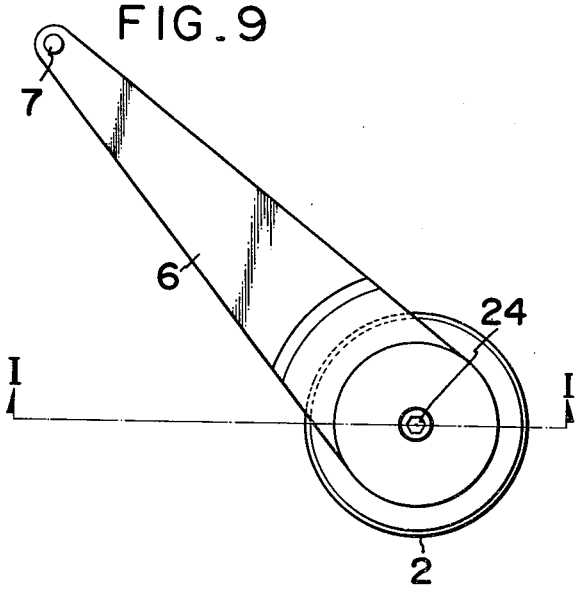
FIG. 9 is a plan view of a modification of the wrench.
Figure 10:
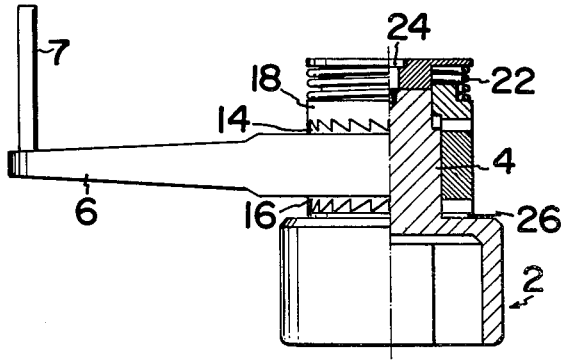
FIG. 10 is a cross-sectional front view taken along the line I—I of FIG. 9.

In FIG. 9 and FIG. 10, a modification of the wrench of the present invention is disclosed. The modification is characterized in that it can be manually operated with a handle lever 7 welded to the upper surface of the drive lever 6.

The construction of the mechanical valve 32 which also forms a part of the present invention is described in detail.

The hydraulic actuator 10 of a reciprocating type comprises a piston 40 and the reciprocating rod 12 which are movable in either the left or right longitudinal direction.

The mechanical valve 32 which, as described above, is shouldered on the hydraulic actuator 10 substantially consists of a directional control valve 44 and a pilot valve 46.

Figure 7:
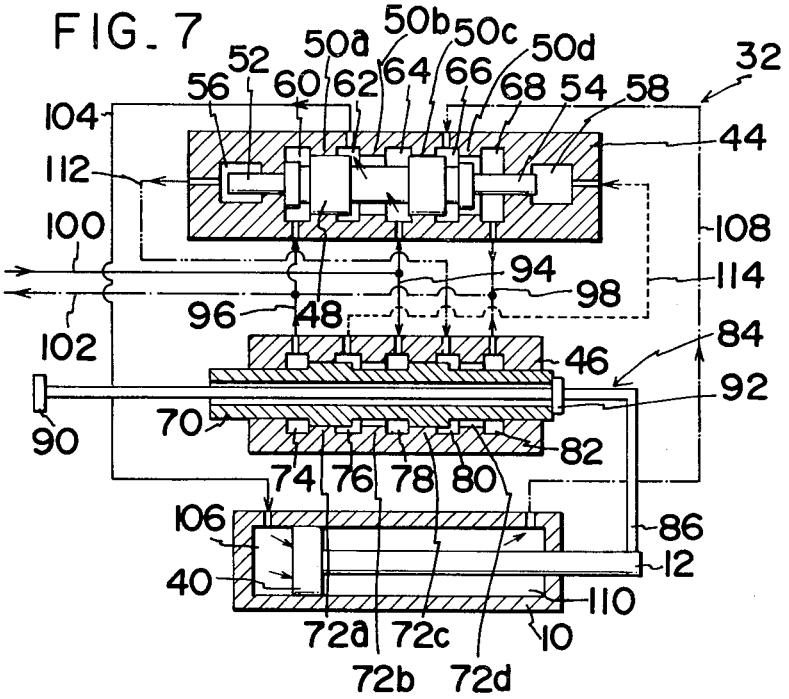
FIGS. 7 and 8 are schematic cross-sectional views of the mechanical valve showing the flow of the pressurized fluid within the valve.

The directional control valve 44, as shown in FIG. 7, includes a spool valve 48 which is slidable in either right or left direction within the valve body 44 and is provided with 5 port chambers 60, 62, 64, 66 and 68 defined by spaced-apart reduced circular portions 50*a*, 50*b*, 50*c* and 50*d*. The valve 44 is further provided with a left-hand plunger 52 disposed at the left side relative to the spool valve 48 and a right-hand plunger 54 disposed at the right side relative to the spool valve 48. These plungers 52 and 54 are disposed in corresponding left and right plunger chambers 56 and 58 respectively.

The pilot valve 46 includes a spool valve 70 which is slidable in either the right or left direction and is provided with 5 chambers 74, 76, 78, 80 and 82 defined by four reduced circular portions 72*a*, 72*b*, 72*c* and 72*d*. An actuating rod 84 is slidably disposed in the spool valve 70 parallel to the reciprocating rod 12 of the hydraulic actuator 10 and has the leg portion 86 thereof secured to the proximal end of the recprocating rod 12. For determining or restricting the slide stroke which corresponds to the stroke(a) of the reciprocating rod 12 of the hydraulic actuator 10, the actuating rod 84 is provided with stopper 90 and 92 at both end portions in place respectively.

As for the lines for carrying fluid pressure, numeral 94 is a line which communicates the chamber 64 of the direction control valve 44 to the chamber 78 of the pilot valve 46, numeral 96 is a line which communicates the chamber 60 to the chamber 74, and 98 is a line which communicates the chamber 68 to the chamber 82.

The line 94 is communicated with a supply line 100 such that the pressurized fluid is supplied to the line 94 by way of the supply line 100 while the line 96 and line 98 are communicated with a tank (not shown in the drawing) by way of a return line 102.

Numeral 104 is a line which communicates the chamber 62 of the directional control valve 44 to a left-hand chamber 106 of the hydraulic actuator 10, numeral 108 is a line which communicates the chamber 66 to a right-hand chamber 110 of the hydraulic actuator 10, numeral 112 is a line which communicates the chamber 80 of the pilot valve 46 to the left-hand plunger chamber 56 of the directional control valve 44 and numeral 114 is a line which communicates the chamber 76 to the right-hand plunger chamber 58.

The mechanical valve 32 is operated as follows.

In FIG. 7, when the reciprocating rod 12 of the actuating cylinder 10 slides on in a left-hand direction, the stopper 92 of the actuating rod 84 comes into contact with the spool valve 70 of the pilot valve 46 and shifts the spool valve 70 toward the left. Due to the shifting, the pressurized fluid supplied from the supply line 100 passes through the chamber 78 and 76 of the pilot valve 46 in sequence and subsequently is supplied to the line 114 and flows into the right-hand plunger chamber 58 of the directional control valve 44. Thus charged pressurized fluid pushes the plunger 54 in a left-hand direction so that the spool valve 48 as a whole moves toward the left. Accordingly, the pressurized fluid charged into the chamber 64 by way of the line 94 passes through the chamber 62 and the line 104 in sequence and flows into the left-hand chamber 106 of the hydraulic cylinder 14 and pushes the piston 40 and the reciprocating rod 12 toward the right. As the reciprocating rod 12 moves toward the right at a predetermined stroke, the left-hand stopper 90 of the actuating rod 84 comes into contact with the spool valve 70 of the pilot valve 46 and shifts the spool valve 70 toward the right.

Figure 8:
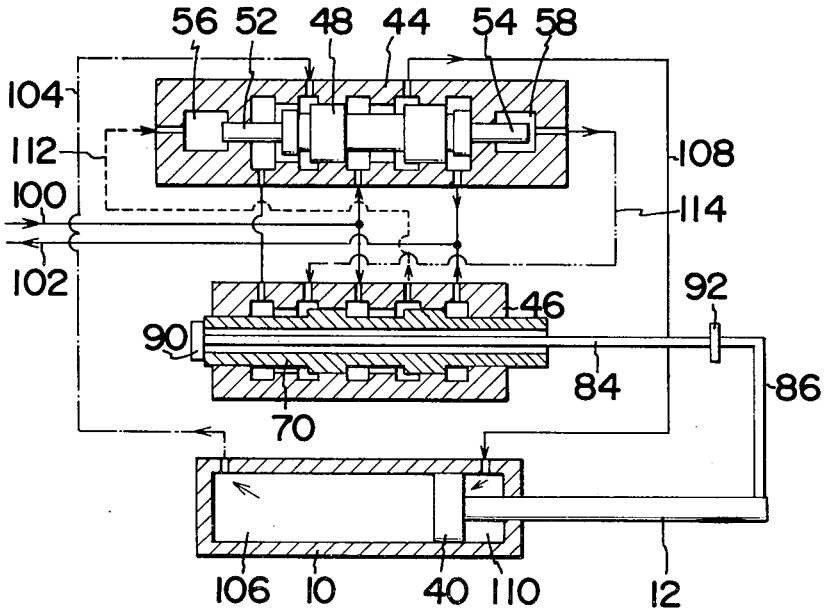

Accordingly, the mechanical valve 32 takes the position shown in FIG. 8, wherein the pressurized fluid is supplied into the right-hand chamber 110 of the hydraulic cylinder 10 and the reciprocating rod 12 retracts toward the left.

As long as the pressurized fluid is continuously supplied to the mechanical valve 32 in the above manner, the pressurized fluid is alternately and automatically supplied to the left and right chambers of the hydraulic cylinder 10 so that the reciprocating rod 12 of the hydraulic actuator 10 continuously and automatically repeats the reciprocating movement.

As has been described heretofore, the wrench of the present invention has following advantages.

1. Since the drive lever has right-hand and left-hand radial ratchet teeth on respective faces of the torquing end thereof, the wrench means can conduct the fastening and dismounting of bolts with minimum replacement of the parts thereof.

2. Since the hydraulic cylinder can always exert the force on the pivoting end of the drive lever at a right angle, the optimal torque is given to the socket and the bolt received in the socket.

3. Due to the provision of a mechanical valve, the hydraulic actuator is given continuous reciprication thereof without necessitating any electric or electronic means such as a solenoid valve or relays.

4. Since the wrench is of a simple yet rigid construction, the device is substantially free from mechanical failures and also brings about low production cost.

What we claim is:

1. A wrench for fastening and unfastening a bolt or the like comprising:

a socket comprising a bolt receiving portion and an engaging portion, said engaging portion having a first part and a second part, said second part having a circular cross-section;

a drive lever having an annular portion at a torquing end thereof, said annular portion being rotatably mounted on said circular cross-section of said second part and having right-hand radial teeth and left-hand radial teeth formed on opposed and axially spaced faces of said annular portion;

a ratchet cap nonrotatably received on said first part of said engaging portion of said socket, said ratchet cap having ratchet teeth formed on a face thereof;

a biasing means detachably mounted on said socket for biasingly meshing said ratchet teeth of said ratchet cap with said right-hand radial teeth;

said drive lever being oscillateable to thereby intermittently rotate said socket in a right-hand direction through said right-hand radial teeth on said drive lever and said ratchet teeth on said ratchet cap to thereby tighten said bolt;

said ratchet cap being removable from said socket to thereby allow said drive lever to be removed from the socket and turned 180 degrees to be replaced on the socket such that said left-hand radial teeth on said drive lever are engageable with ratchet teeth on another ratchet cap placed on said second part of said engaging portion of said socket, whereby oscillation of said drive lever intermittently rotates said socket in a left-hand direction through said left-hand radial teeth on said drive lever and said ratchet teeth on said other ratchet cap to thereby loosen said bolt.

2. A wrench for fastening and unfastening a bolt or the like comprising:

a socket comprising a bolt receiving portion and an engaging portion, said engaging portion having a first part and a second part, said second part having a circular cross-section;

a drive lever having an annular portion at a torquing end thereof, said annular portion being rotatably mounted on said second part and having right-hand radial teeth and left-hand radial teeth formed on opposed and axially spaced faces of said annular portion;

a ratchet cap nonrotatably received on said first part of said engaging portion of said socket, said ratchet cap having ratchet teeth formed on a face thereof;

a biasing means detachably mounted on said socket for biasingly meshing said ratchet teeth of said ratchet cap with said right-hand radial teeth;

a reaction force lever having an annular section at a torquing end, said annular section being rotatably mounted on said second part of said engaging portion of said socket, said reaction force lever being angularly displaced relative to said drive lever; and a reciprocal actuator means having one end thereof pivotally connected to said drive lever and another end pivotally connected to said reaction force lever to thereby form a triangular construction with said two levers, whereby reciprocation of said reciprocal actuator means oscillates said drive lever which in turn intermittently rotates said socket in a right-hand direction through said right-hand ratchet teeth on said drive lever and said ratchet teeth on said ratchet cap to thereby tighten said bolt;

said ratchet cap being removable from said socket to thereby allow said drive lever, reaction lever and reciprocal actuator means to be removed from the socket as a unit and turned 180 degrees to be replaced on the socket such that said left-hand ratchet teeth on said drive lever are engageable with ratchet teeth on another ratchet cap placed on said second part of said engaging portion of said socket, whereby reciprocation of said reciprocal actuator means intermittently rotates said socket in a left-hand direction through said left-hand ratchet teeth on said drive lever and said ratchet teeth on said other ratchet cap to thereby loosen said bolt.

3. A wrench according to claim 2, wherein said biasing means comprises a spring-biasing plate and fastening means detachably mounting said spring-biasing plate on said socket, said biasing means further comprising a spring disposed between said spring-biasing plate and said ratchet cap, whereby said spring biasingly urges said ratchet cap towards said ratchet teeth on said drive lever.

4. A wrench according to claim 3, wherein said fastening means is adjustable to adjust the biasing force on said ratchet cap.

5. A wrench according to claim 2, wherein said bolt receiving portion of said socket has an outer diameter greater than the outer diameter of said circular cross-section of said second part of said engaging portion of said socket, bolt receiving portion having a radially disposed face at the junction between said second part and said bolt receiving portion, and a circular flat packing disposed on said radially disposed face for protecting said radial teeth on said drive lever during tightening or loosening of said bolt.

6. A wrench according to claim 2, wherein said first part of said engaging portion of said socket has a square cross-section.

7. A wrench according to claim 2, wherein said reciprocal actuator means comprises a cylinder and a piston operable within the cylinder, said piston having a piston rod, said piston rod and said cylinder being pivotably connected to said drive lever and said reaction lever.

8. A wrench according to claim 7, wherein said reciprocal actuator means further compirses a mechanical valve means having a directional control valve and a pilot valve, said pilot valve comprising a spool valve slidable longitudinally within and relative to said pilot valve and an actuating rod which is slidably disposed in said spool valve parallel to said piston rod, said actuating rod being connected to said piston rod, said actuating rod being provided with stoppers at end portions thereof which define the slide stroke of said piston rod, whereby said mechanical valve means controls the reciprocation of said piston rod which in turn effects said oscillation of said drive lever.

9. A wrench assembly for fastening and unfastening a bolt or the like comprising:

a socket comprising a bolt receiving portion and an engaging portion, said engaging portion having a first part and a second part, said second part having a circular cross-section;

a drive lever having an annular portion at a torquing end thereof, said annular portion being rotatably mounted on said circular cross-section of said second part and having right-hand radial teeth and left-hand radial teeth formed on opposed and axially spaced faces of said annular portion;

a first ratchet cap nonrotatably received on said first part of said engaging portion of said socket, said first ratchet cap having ratchet teeth formed on a face thereof;

a biasing means detachably mounted on said socket for biasingly meshing said ratchet teeth of said first ratchet cap with said right-hand radial teeth;

a reaction force lever having an annular section at a torquing end, said annular section being rotatably mounted on said second part of said engaging portion of said socket, said reaction force lever being angularly displaced relative to said drive lever;

a reciprocal actuator means having one end thereof pivotally connected to said drive lever and another end pivotally connected to said reaction force lever to thereby form a triangular construction with said two levers, whereby reciprocation of said reciprocal actuator means oscillates said drive lever which in turn intermittently rotates said socket in a right-hand direction through said right-hand ratchet teeth on said drive lever and said ratchet teeth on said first ratchet cap to thereby tighten said bolt;

said first ratchet cap being removable from said socket to thereby allow said drive lever, reaction lever and reciprocal actuator means to be removed from the socket as a unit and turned 180 degrees to be replaced on the socket; and a second ratchet cap for placing on said socket in lieu of said first ratchet cap and having ratchet teeth engageable with the left-hand radial teeth on said drive lever such that reciprocation of said reciprocable actuator means intermittently rotates said socket in a left-hand direction through said left-hand radial teeth on said drive lever and said ratchet teeth on said second ratchet cap to thereby loosen said bolt.

10. A wrench for fastening or dismounting a bolt, comprising:

a socket comprising a bolt receiving portion and an engaging portion, said engaging portion having an upper part and a lower part of a circular cross-section;

a drive lever made of an elongated plate, said drive lever having an annular portion at a torquing end thereof, said annular portion rotatably mounted on said lower part of said engaging portion and having right-hand radial teeth and left-hand radial teeth formed at top and bottom faces of said annular portion;

a ratchet cap unrotatably received by said upper part of said engaging portion, said ratchet cap having circular ratchet teeth formed to the lower periphery thereof;

a biasing means disposed over said ratchet cap for biasingly meshing said ratchet cap with said right-hand radial teeth;

a reaction force lever made of an elongated plate, said reaction force lever having an annular portion at a torquing end, said annular portion being rotatably mounted on said lower part of said engaging portion angularly displaced from said annular portion of said drive lever;

a hydraulic actuator having a reciprocating rod thereof pivotally connected to the free end of said drive lever and a base end pivotally connected to the free end of said reaction force lever thus forming a triangular construction along with said two levers; and a mechanical valve mounted on said hydraulic actuator, said mechanical valve consisting of a directional control valve and a pilot valve, said pilot valve comprising a spool valve which is slidable longitudinally within and relative to said pilot valve and an actuating rod which is slidably disposed in said spool valve parallel to said reciprocating rod of said hydraulic actuator, said actuating rod having one end thereof secured to the proximal end of said reciprocating rod, said actuating rod being further provided with stoppers at end portions respectively which define the slide stroke of said reciprocating rod;

whereby with the oscillation of said drive lever, said ratchet cap, said socket and said bolt received in said socket are intermittently roatated in one direction.

* * * * *